US006742918B2

(12) United States Patent
Collins

(10) Patent No.: US 6,742,918 B2
(45) Date of Patent: Jun. 1, 2004

(54) MOVABLE CONDENSER LENS

(75) Inventor: Tony E. Collins, Alexandria, IN (US)

(73) Assignee: Guide Corporation, Pendleton, IN (US)

( * ) Notice: Subject to any disclaimer, the term of this patent is extended or adjusted under 35 U.S.C. 154(b) by 0 days.

(21) Appl. No.: 10/121,977

(22) Filed: Apr. 12, 2002

(65) Prior Publication Data

US 2003/0193813 A1 Oct. 16, 2003

(51) Int. Cl.[7] ..... F21V 1/00

(52) U.S. Cl. ..... 362/509; 362/512; 362/513; 362/538; 362/467; 362/531; 362/319; 362/465

(58) Field of Search ..... 362/509, 466, 362/531, 467, 468, 465, 515, 512, 513, 538, 319

(56) References Cited

U.S. PATENT DOCUMENTS

| | | | |
|---|---|---|---|
| 2,423,322 | A | 7/1947 | Hurley, Jr. |
| 4,345,303 | A | 8/1982 | Gerard et al. |
| 4,369,488 | A | 1/1983 | Brun |
| 4,392,187 | A | 7/1983 | Bornhorst |
| 4,602,321 | A | 7/1986 | Bornhorst |
| 4,768,135 | A | 8/1988 | Kretschmer et al. |
| 4,825,343 | A | 4/1989 | Nakata |
| 4,857,794 | A | 8/1989 | Watanabe |
| 4,967,319 | A | 10/1990 | Seko |
| 4,985,816 | A | 1/1991 | Seko et al. |
| 5,068,768 | A | 11/1991 | Kobayashi |
| 5,138,540 | A | 8/1992 | Kobayashi et al. |
| 5,438,486 | A | 8/1995 | McNair |
| 5,567,034 | A | 10/1996 | Dietewich et al. |
| 5,660,454 | A | 8/1997 | Mori et al. |
| 5,758,955 | A | 6/1998 | Belliveau |
| 5,899,559 | A | 5/1999 | Lachmayer et al. |
| 5,911,502 | A | 6/1999 | Zillgitt et al. |
| 5,915,829 | A | 6/1999 | Kalze et al. |
| 5,931,572 | A | 8/1999 | Gotoh |
| 5,938,319 | A | 8/1999 | Hege |
| 5,980,066 | A | 11/1999 | Belliveau et al. |
| 6,030,099 | A | 2/2000 | McDermott |
| 6,049,749 | A | 4/2000 | Kobayashi |
| 6,186,651 | B1 | 2/2001 | Sayers et al. |
| 6,280,071 | B1 | 8/2001 | Yamamoto et al. |

FOREIGN PATENT DOCUMENTS

| | | |
|---|---|---|
| EP | 0 303 072 A2 | 2/1989 |
| JP | 08335402 A | 12/1996 |

*Primary Examiner*—Sandra O'Shea
*Assistant Examiner*—Bertrand Zeade
(74) *Attorney, Agent, or Firm*—Ice Miller; Russell E. Fowler, II

(57) ABSTRACT

A system for adjusting the direction of a light beam from a headlamp assembly comprises a condenser lens which is movable along an arcuate path. As a vehicle turns a corner, the system moves the condenser lens along the arcuate path, so as to direct the light beam in the direction that the vehicle is moving. Because the condenser lens follows an arcuate path, the light beam is not distorted, allowing for greater angular displacement of the light beam.

17 Claims, 7 Drawing Sheets

MOVABLE CONDENSER LENS

BACKGROUND OF THE INVENTION

The present invention relates generally to automotive lamps. In particular, the present invention relates to an assembly for moving the light beam pattern of a headlamp.

Generally, conventional automotive headlamps utilize a reflector of parabolic shape and an incandescent lamp. However, a projector headlamp, which has recently come into use more widely in the United States, is an automotive headlamp that typically utilizes a reflector of elliptical shape and may include a high intensity discharge gas lamp. A projector headlamp also generally requires the use of a condensing lens, which is located in front of the lamp and the reflector, to focus the light emitted by the assembly into a concentrated beam pattern which meets applicable automotive lighting requirements.

In response to changing driving conditions, it can become desirable to move the beam pattern relative to the vehicle. For example, when a vehicle is being driven around a corner, it may be desirable for the beam pattern of that vehicle's forward lighting system to be adjusted, axially and/or laterally, such that the emitted light better illuminates the area in the direction the vehicle is turning. Additionally, adverse weather conditions or an increase or decrease in a vehicle's speed may also result in circumstances where adjustment of the vehicle's forward lighting beam pattern may become desirable. Automotive headlamps that can be adjusted in this manner are generally known in the industry as adaptive front lighting systems ("AFS").

AFS for projector headlamps are generally known in the art. Such systems generally move the emitted light beam pattern by moving the entire projector headlamp assembly. For example, U.S. Pat. No. 6,186,651 (the "'651 patent") discloses the use of solenoids, motors, cams and such to move the reflector, condenser lens and light shield of the projector headlamp assembly. This method, however, has some significant disadvantages. For example, laterally moving the entire projector lamp distorts the assembly's beam pattern from its original shape. This can cause the emitted light to become noncompliant with applicable government regulations. Additionally, moving the entire projector lamp requires a large amount of space behind the headlamp to keep the headlamp from swinging into other parts. An additional shortcoming of this approach is that moving the whole assembly requires at least some movement of electrical wires that supply power to the light source. Such movement can eventually result in a complete failure of the assembly. Moreover, when adjustments in the light's beam pattern are necessary, moving the large mass of the entire headlamp requires a longer than ideal response time or a larger and less efficient means for moving the assembly.

It is also generally known to pivot the condenser lens in order to adjust the aim point of the headlamp assembly in the vertical plane. For example, the '651 patent discloses the use of a pivoting condensing lens in conjunction with a pivoting light shield to allow for a single headlamp assembly to provide illumination for both low beam and high beam conditions. While useful for small adjustments in aiming, such as when shifting between low beam illumination and high beam illumination, pivoting the condensing lens around an axis results in unacceptable levels of beam distortion for angles which are desired when a vehicle is turning.

It is also generally known to move a condenser lens within a plane that is perpendicular to the horizontal axis of the headlamp. Such a system is disclosed in U.S. Pat. No. 5,915,829 (the "'829 patent"). According to the '829 patent, a lens is mounted within two mountings, both of which are in a plane perpendicular to the horizontal headlamp axis. These mountings are then used to move the lens within the plane perpendicular to the horizontal headlamp axis, so as to control the position of the light beam of the headlight assembly. Although the system disclosed in the '829 patent does allow for some horizontal displacement of a light beam, it is of limited usefulness when a vehicle is turning. Another disadvantage of this system is that as the lens is moved within the mountings, the incidence angle of the light striking the lens increases, causing undesired distortion of the light beam formed by the lens. Thus, the angular displacement of the light beam is limited.

Therefore, it is desirable to provide a headlamp assembly that allows for significant angular displacement of the light beam of a headlamp assembly without excessive light beam distortion and without the need to move the entire headlamp assembly. It is further desired that the system be of inexpensive and dependable construction. It is further desired that the headlamp assembly be easily configured to fit within space confines of a variety of vehicle designs.

BRIEF SUMMARY OF THE INVENTION

In accordance with the present invention, a headlamp assembly is provided which overcomes the disadvantages of the prior art by providing a condenser lens that is movable along an arcuate path. One exemplary embodiment of the invention comprises an elliptical reflector having two focal points. A light source is located proximate to the first focal point, and a condenser lens is rotatable around the second focal point. As a vehicle turns, the condenser lens is moved along an arcuate path such that the light beam formed by the headlamp assembly is projected in the direction which the vehicle is turning.

The invention provides a headlamp assembly that allows for significant angular displacement of the light beam of a headlamp assembly without excessive light beam distortion and without the need to move the entire headlamp assembly. The invention further provides a headlamp assembly which is inexpensive and of dependable construction. Moreover, it is advantageous that a headlamp assembly according to the present invention can be easily configured to fit within space confines of a variety of vehicle designs.

DETAILED DESCRIPTION OF THE INVENTION

Figure 1A:
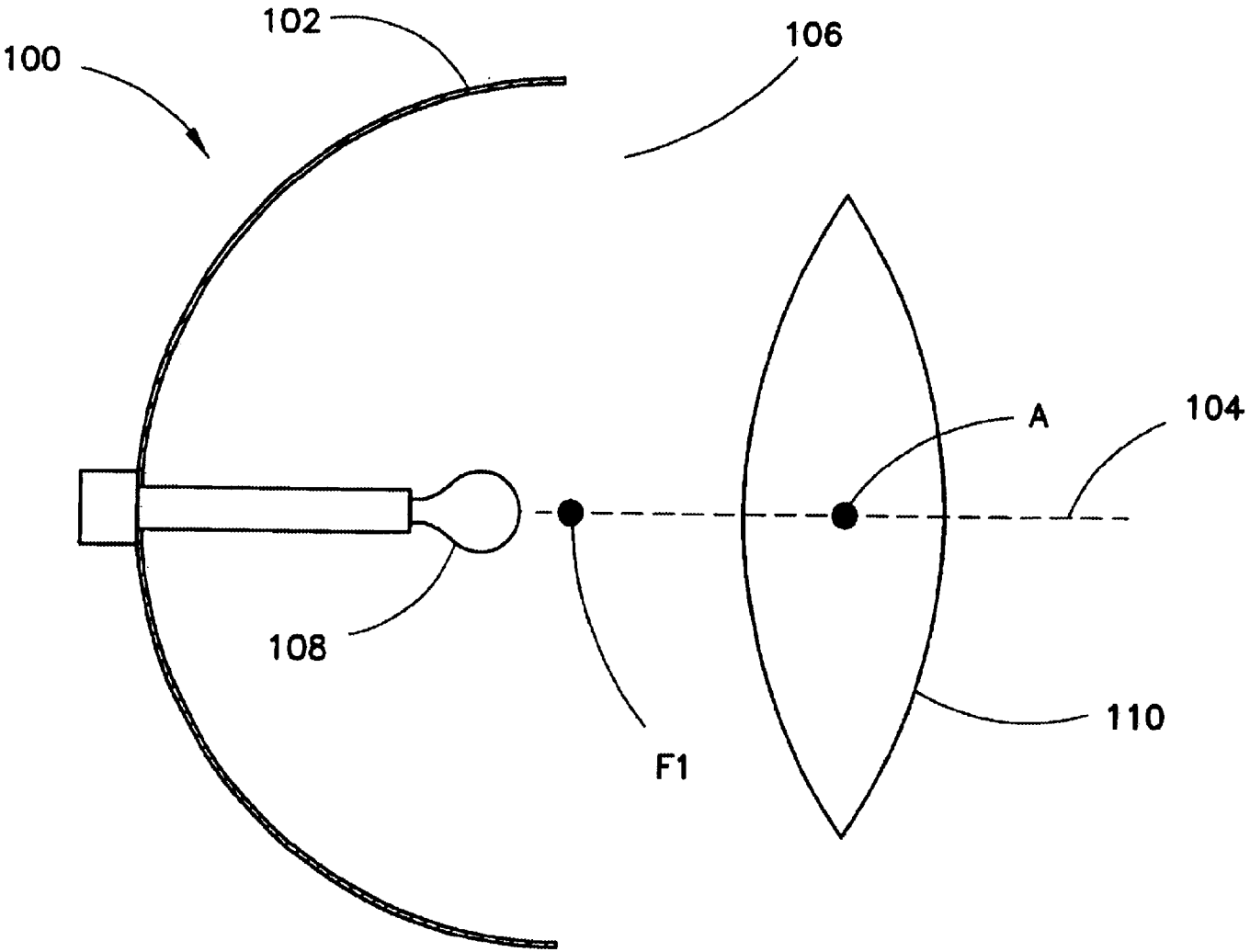
FIG. 1A is a schematic top plan view of one exemplary embodiment of the invention.

Referring now to FIG. 1A, a schematic top plan view of one exemplary embodiment of the invention is shown. Headlamp assembly 100, which is installed in a vehicle, comprises reflector 102 having a reflector axis 104. Reflector 102 has focal point F1 and forward-facing reflector opening 106. Light source 108 is located substantially at focal point F1. Condenser lens 110 is disposed forward of reflector opening 106. For purposes of explanation, point A is positioned at the approximate center of mass of condenser lens 110. Accordingly, a light beam (not shown) is projected forward from reflector 102 and focused by condenser lens 110 so as to provide illumination in front of the vehicle.

Figure 1B:
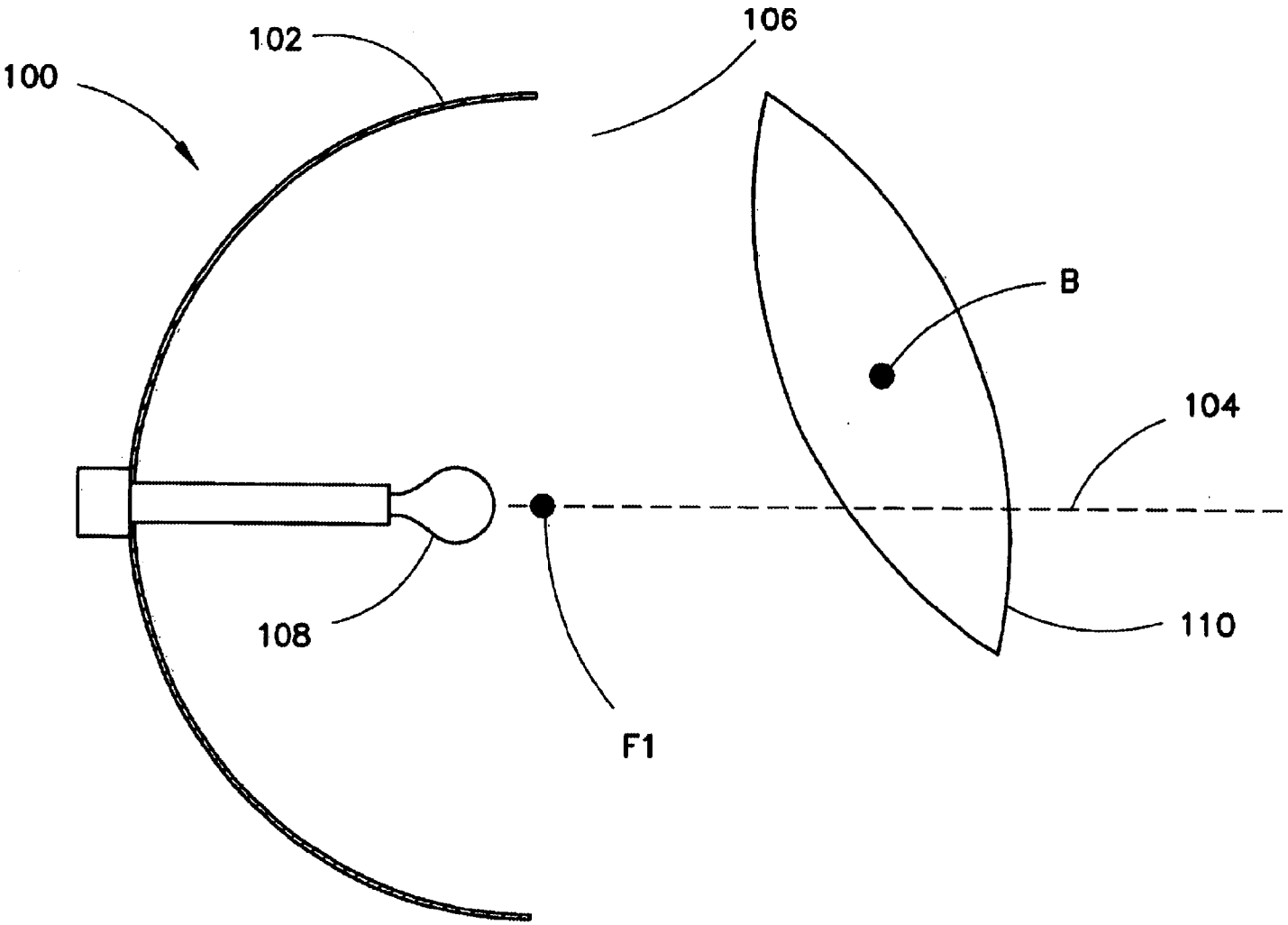
FIG. 1B is a schematic top plan view of the embodiment of the invention shown in FIG. 1A with the condenser lens in an alternative position.

Referring now to FIG. 1B, headlamp assembly 100 is shown with condenser lens 110 in an alternate position in accordance with the present invention when the vehicle is turning to the left. The approximate center of mass of condenser lens 110 when condenser lens 110 is in the alternate position is indicated by point B. In this embodiment, the linear distance from F1 to point A shown in FIG. 1A is equal to the linear distance from F1 to point B in FIG. 1B. When condenser lens 110 is in this alternate position, condenser lens 110 focuses the light beam in a direction to the left of the direction of the light beam produced in the configuration of FIG. 1A above. The movement of condenser lens 110 is accomplished by rotating the lens with respect to a point that is not co-located with point A. Accordingly, the path followed by condenser lens 110 from one position to another position about the point of rotation may be described as being arcuate.

Those of skill in the art will recognize that the present invention may be practiced with a number of variations. For example, the point of rotation need not be substantially near to the focal point of the reflector. Furthermore, the arcuate path may be of any curvilinear shape such as, but not limited to, generally circular or elliptical. These and other variations being within the scope of the present invention.

Figure 2A:
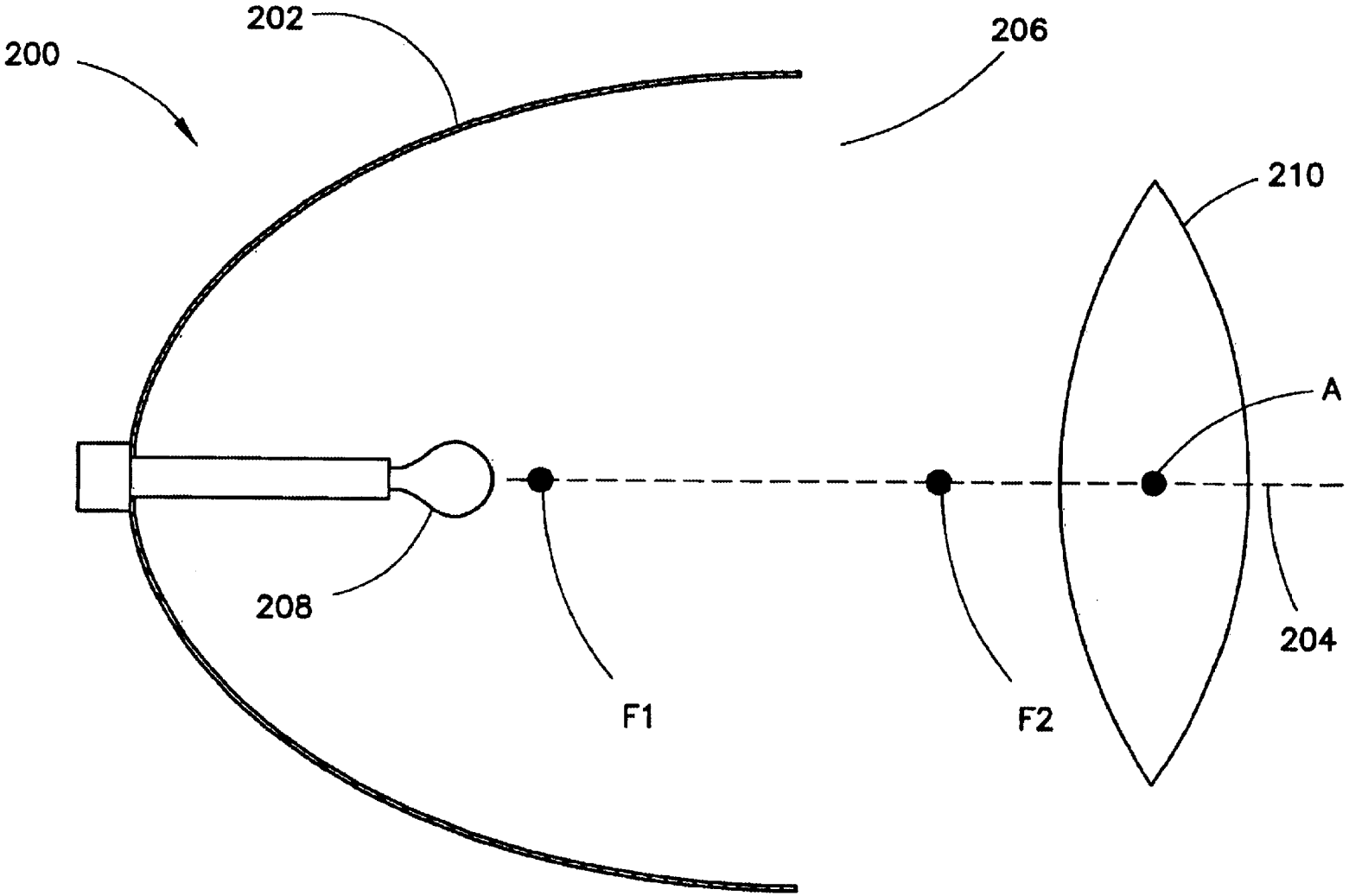
FIG. 2A is a schematic top plan view of an alternative exemplary embodiment of the invention using a elliptical reflector.

Moreover, the present invention may be practiced with a variety of headlamp assembly types and configurations. For example, a second exemplary embodiment of the invention is shown in FIG. 2A. According to this embodiment, headlamp assembly 200, which is installed in a vehicle, comprises elliptical reflector 202 having a reflector axis 204. Elliptical reflector 202 has a first focal point F1, a second focal point F2 and forward-facing reflector opening 206. Light source 208 is located substantially at first focal point F1 of reflector 202. Condenser lens 210 is disposed forward of reflector opening 206 and forward of second focal point F2 of parabolic reflector 202. For purposes of explanation, point A is positioned at the approximate center of mass of condenser lens 210. Accordingly, a light beam (not shown) is projected forward from reflector 202 and focused by condenser lens 210 so as to provide illumination in front of the vehicle.

Figure 2B:
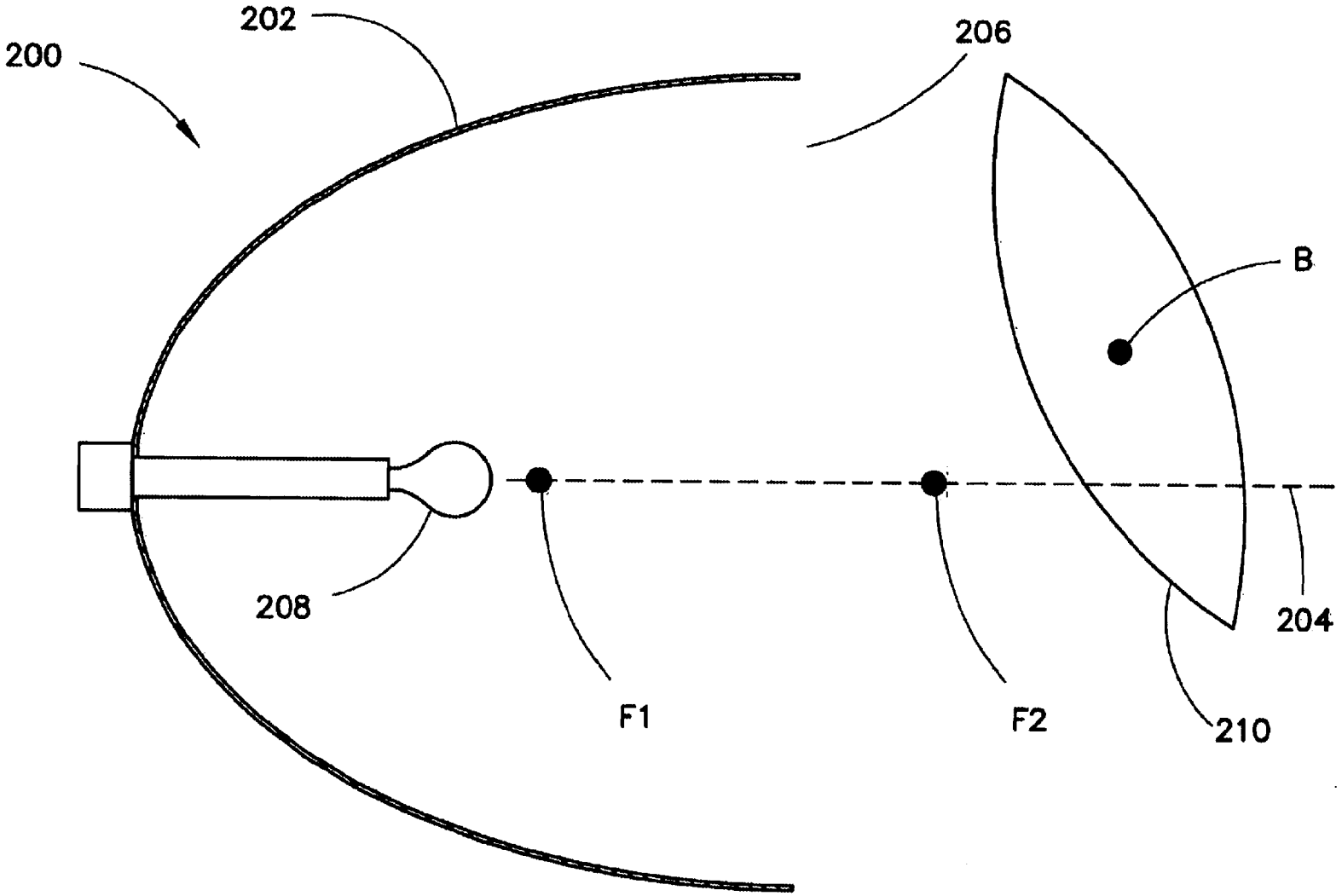
FIG. 2B is a schematic top plan view of the alternative embodiment of the invention shown in FIG. 2A with the condenser lens in an alternative position.

Referring now to FIG. 2B, headlamp assembly 200 is shown with condenser lens 210 in an alternate position in accordance with the present invention when the vehicle is turning to the left. The approximate center of mass of condenser lens 210 when condenser lens 210 is in the alternate position is indicated by point B. In this embodiment, the linear distance from F2 to point A shown in FIG. 2A is equal to the linear distance from F2 to point B in FIG. 2B. When condenser lens 210 is in this alternate position, the condenser lens focuses the light beam in a direction to the left of the direction of the light beam produced in the configuration of FIG. 2A above.

Figure 3A:
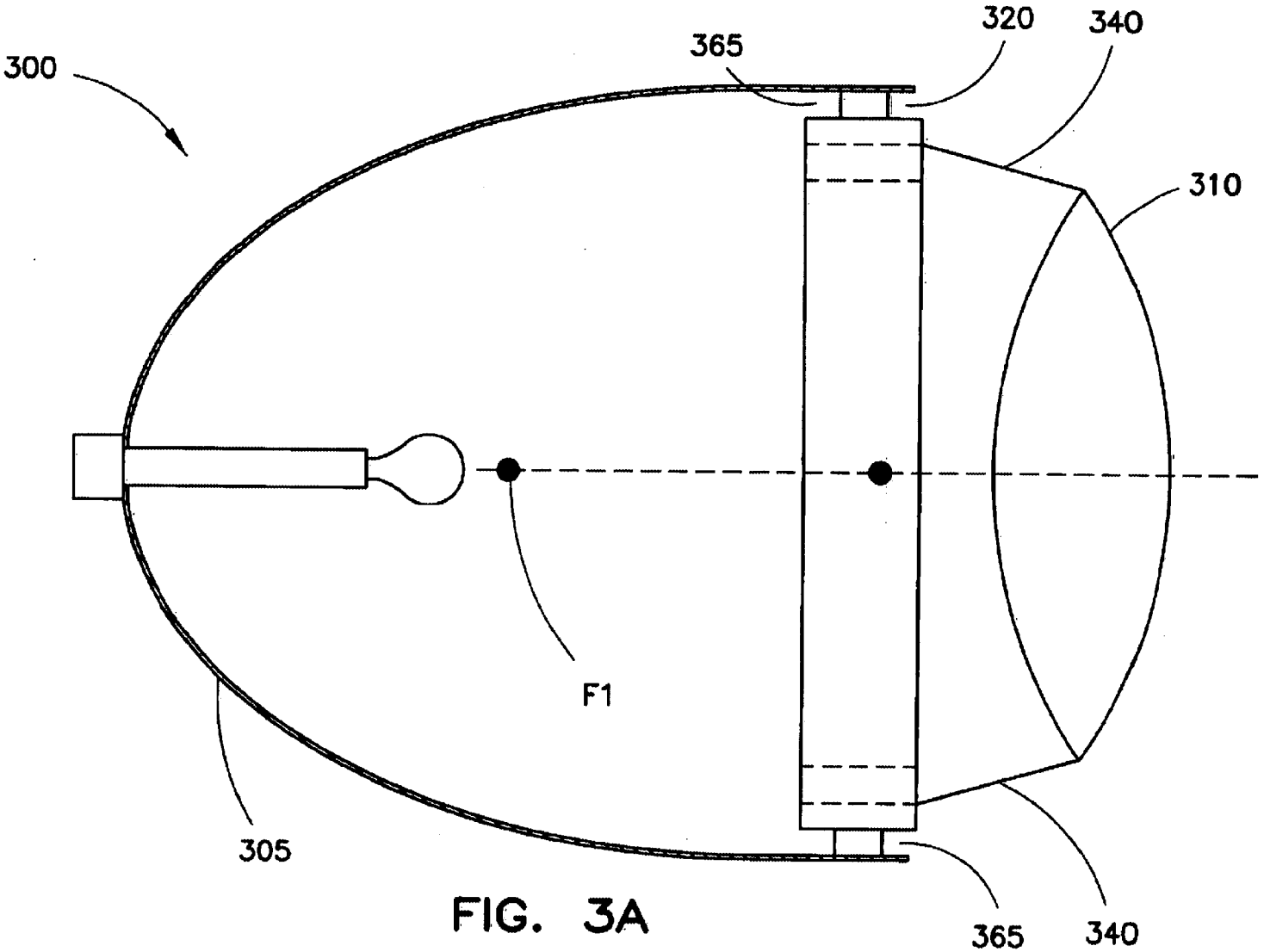
FIG. 3A is a schematic top plan view of an alternative exemplary embodiment of the invention using a double gimballed mount.
Figure 3B:
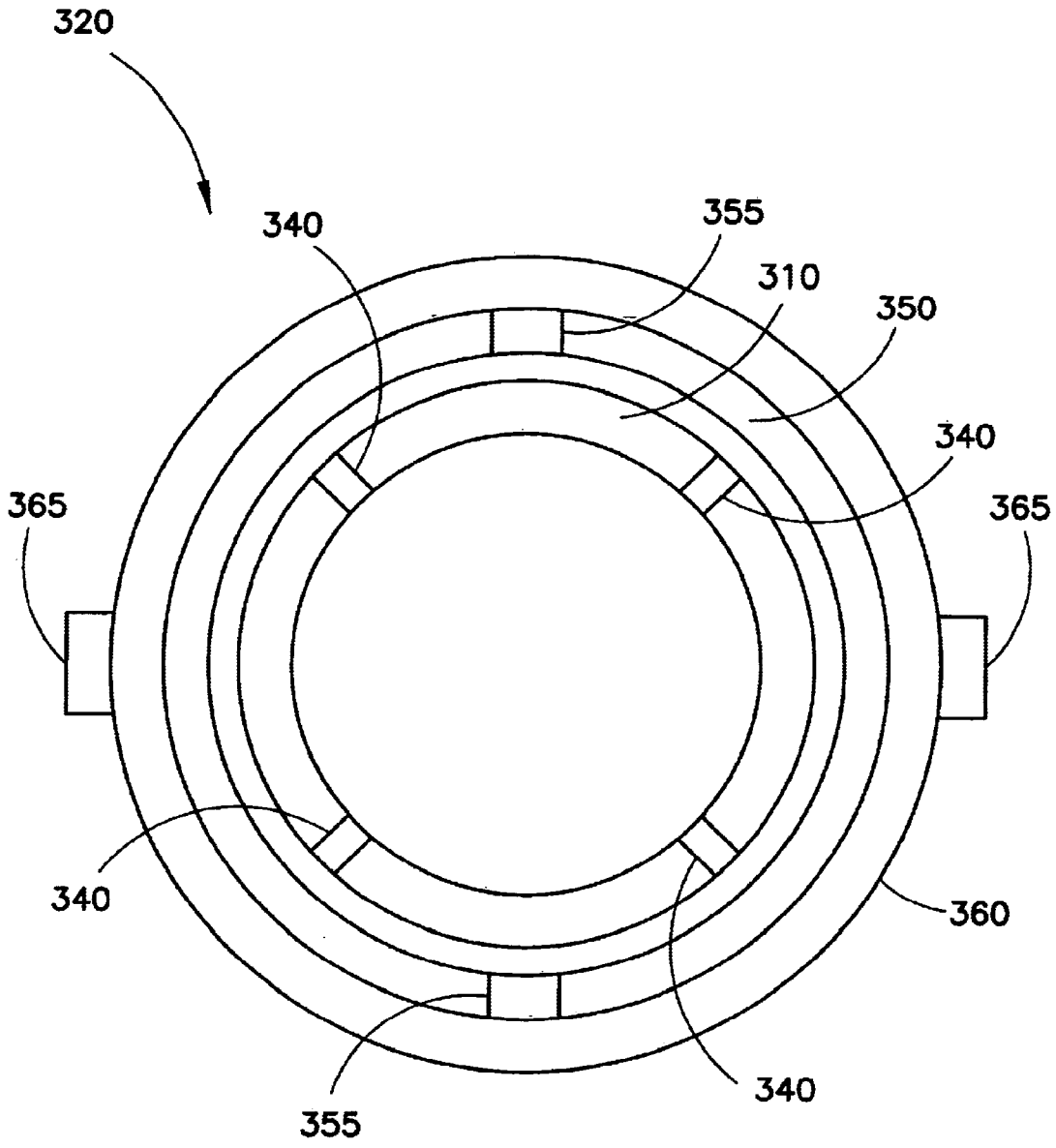
FIG. 3B is a schematic front plan view of the alternative embodiment of the invention shown in FIG. 3A.

As will be understood by those of skill in the art, a low beam may be shifted to a high beam by moving the condenser lens in the vertical plane. Accordingly, the present invention may also be used to provide for both high and low beams. Referring to FIG. 3A, headlamp assembly 300 is shown with condenser lens 310. Condenser lens 310 is mounted to double gimballed mount 320 by mounting brackets 340 as shown in FIG. 3B. Double gimballed mount 320 functions as a means for moving condenser lens 310 in an arcuate path. Mounting brackets 340 are fixed to inner mount 350. Inner mount 350 is rotatably connected to outer mount 360 by inner gimbals 355. Outer mount 360 is connected to reflector 305 by outer gimbals 365.

Thus, movement of the light beam in the left and right direction (horizontal plane) is accomplished by rotating condenser lens 310 about outer gimbals 365, resulting in condenser lens 310 being moved in an horizontal arcuate path. Moving the light beam between high and low beam positions (vertical plane) is accomplished by rotating condenser lens 310 about inner gimbals 355 resulting in condenser lens 310 being moved in a vertical arcuate path.

Figure 4:
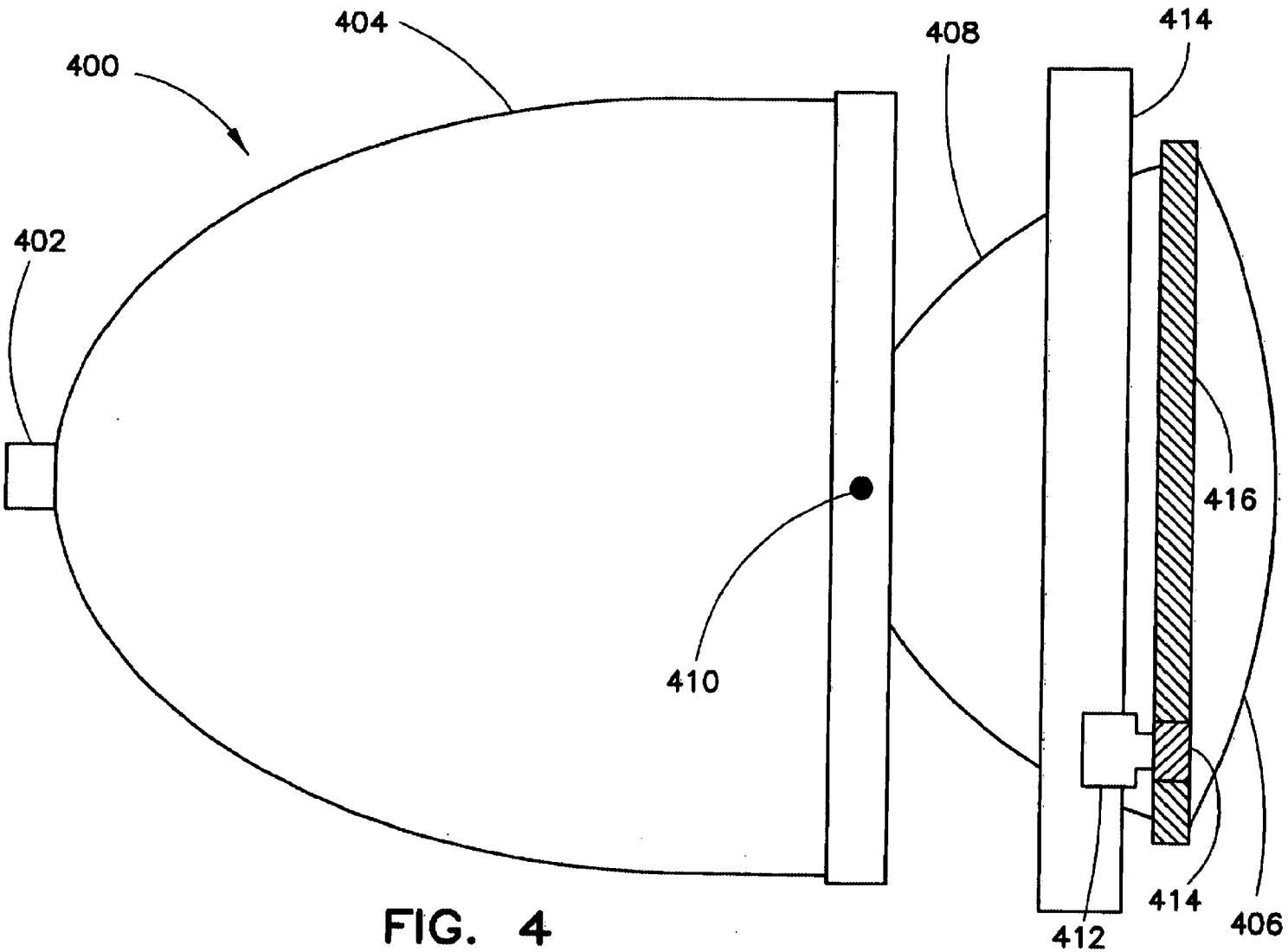
FIG. 4 is a top plan view of an alternative mounting system for practicing the invention.

Referring now to FIG. 4, a schematic top plan view of an alternative exemplary mounting system for practicing the invention is shown. Headlamp assembly 400 includes light source 402, reflector 404 and condenser lens 406. Condenser lens 406 is fixedly attached to horizontal lens connector 416 and bracket 408. Bracket 408 is rotatably connected to reflector 404 at pivot connector 410. Means for moving condenser lens 406 in an arcuate path in this embodiment is provided by horizontal stepper motor 412 which is fixedly connected to condenser lens mount 414. Stepper motor 412 comprises drive gear 414 which is operably engaged with horizontal lens connector 416.

Operation of one embodiment of the present invention is explained by reference to FIG. 4. Stepper motor 412 is responsive to a means for computing angular displacement. The means for computing angular displacement may comprise, for example, a microchip. Input signals to the microchip may include signals related to the direction the vehicle is going such as may be provided with steering wheel position and/or wheel orientation. Additionally, signals related to vehicle speed may be provided, such as accelerator position, engine speed or wheel rotational speed. Additional signals may also include signals responsive to vehicle loading, such as would be desired when compensating light beam position based on vehicle loading. Those of skill in the art will understand that these and other signals, alone or in a variety of combinations, may be provided within the scope of the present invention.

In response to the input signals, the means for computing angular displacement generates a control signal to stepper motor 412. Stepper motor 412 causes drive gear 414 to rotate. Drive gear 414 operates against horizontal lens connector 416, causing horizontal lens connector 416 to move. Because horizontal lens connector 416 is fixedly attached to condenser lens 406, condenser lens 406 also moves. The motion of condenser lens 406 is forced into an arcuate path around pivot connector 410. Thus, means for moving condenser lens 406 comprises the combination of stepper motor 412 and pivot connector 410. Those of skill in the appropriate art will recognize that a number of alternative embodiments exist for the means for moving condenser lens 406 in an arcuate path. By way of example, but not of limitation, the means for moving may comprise solenoids, motors, cams, gimbals, pivots, tracks, followers, linkages, gears, bearings, pumps, and/or the like. Moreover, the means for moving may include electronic, mechanical, electromechanical, inductive, magnetic, optical, hydraulic, and/or pneumatic devices and/or the like. These and other variants being within the scope of the present invention.

As condenser lens 406 is moved in an arcuate path, the light beam formed by condenser lens 406 moves in the same general direction as condenser lens 406. It has been discovered, that when using an embodiment such that shown in FIG. 4, the light beam can be moved to about sixteen degrees (16°) from the reflector axis without excessive distortion of the light beam when measured at a point twenty-five (25) feet in front of the headlamp assembly.

Those of skill in the art will realize that as described herein, the present invention provides significant advantages over the prior art. Embodiments of the invention which may include elliptical reflector headlamp assemblies provide a headlamp assembly that allows for significant angular displacement of the light beam of a headlamp assembly without excessive light beam distortion and without the need to move the entire headlamp assembly. The invention further provides a headlamp assembly which is inexpensive and of dependable construction. Moreover, it is advantageous that a headlamp assembly according to the present invention can be easily configured to fit within space confines of a variety of vehicle designs. The present invention may be practiced to modify the direction of a light beam in response to vehicle motion, loading, varying driving conditions or terrain. Other objects and features of the present invention will be apparent to those of skill in the art in consideration of the above description, the accompanying drawings, and the following claims.

I claim:

1. A headlamp for projecting light in a forward direction, said headlamp comprising:

a reflector having a reflector axis, a first focal point located along said reflector axis, and a forward-facing reflector opening;

a light source located proximate to the first focal point;

a condenser lens disposed forward of the reflector opening, the condenser lens being movable in an arcuate path; and means for moving the condenser lens in an arcuate path.

2. The headlamp of claim 1, wherein the reflector is generally elliptical, the reflector further comprising a second focal point located along the reflector axis, the condenser lens being spaced apart from the second focal point.

3. The headlamp of claim 2, wherein the arcuate path has a focal point, the focal point of the arcuate path proximate the reflector's second focal point.

4. The headlamp of claim 3, wherein the condenser lens is movable along an arcuate path of up to about 16 degrees.

5. The headlamp of claim 2, further comprising a means for computing angular displacement operably connected to the means for moving the condenser lens.

6. The headlamp of claim 5, wherein the headlamp is located on a vehicle having at least one front wheel, and wherein the means for computing angular displacement comprises means for sensing the position of the at least one front wheel.

7. The headlamp of claim 6, wherein the means for computing angular displacement further comprises means for sensing the speed of the vehicle.

8. The headlamp of claim 5, wherein the headlamp is located on a vehicle having a steering wheel, and wherein the means for computing angular displacement comprises means for sensing the position of the steering wheel.

9. The headlamp of claim 8, wherein the means for computing angular displacement further comprises means for sensing the speed of the vehicle.

10. A method of steering the beam of light projected by a headlamp, the method comprising the steps of:

providing a headlamp for projecting light in a forward direction, the headlamp having a reflector with a reflector axis, a first focal point located along said reflector axis, and a forward-facing reflector opening;

providing a light source located proximate to the first focal point;

providing a condenser lens disposed forward of the reflector opening; the condenser lens being movable in an arcuate path;

providing means for moving the condenser lens in an arcuate path; and moving the condenser lens along the arcuate path the condenser lens moves along the substantially horizontal plane.

11. The method of claim 10, the step of moving the condenser comprising the steps of:

computing a desired angular displacement; and moving the condenser lens to the desired angular displacement.

12. The method of claim 11, wherein the step of computing a desired angular displacement comprises the step of determining the position of at least one front wheel of a vehicle.

13. The method of claim 12, wherein the step of computing a desired angular displacement comprises the step of determining the speed of the vehicle.

14. The method of claim 11, wherein the step of computing a desired angular displacement comprises the step of determining the position of a steering wheel.

15. The method of claim 14, wherein the step of computing a desired angular displacement comprises the step of determining the speed of a vehicle.

16. The method of claim 10, wherein the step of providing means for moving the condenser lens in an arcuate path comprises the step of:

providing means for moving the condenser relative to the reflector, and wherein the step of moving the condenser lens along the arcuate path comprises the step of, moving the condenser lens relative to the reflector.

17. The headlamp of claim 1, wherein the condenser lens is movable relative to the reflector.

* * * * *